US006003481A

United States Patent [19]

Pischinger et al.

[11] Patent Number: 6,003,481

[45] Date of Patent: Dec. 21, 1999

[54] ELECTROMAGNETIC ACTUATOR WITH IMPACT DAMPING

[75] Inventors: Franz Pischinger; Martin Pischinger; Thomas Esch; Guenter Schmitz, all of Aachen, Germany

[73] Assignee: FEV Motorentechnik GmbH & Co. Kommanditgesellschaft, Aachen, Germany

[21] Appl. No.: 09/068,083

[22] PCT Filed: Aug. 22, 1997

[86] PCT No.: PCT/EP97/04565

§ 371 Date: Aug. 4, 1998

§ 102(e) Date: Aug. 4, 1998

[87] PCT Pub. No.: WO98/10175

PCT Pub. Date: Mar. 12, 1998

[30] Foreign Application Priority Data

Sep. 4, 1996 [DE] Germany ..... 296 15 396 U

[51] Int. Cl.[6] ..... F01L 9/04

[52] U.S. Cl. ..... 123/90.11; 251/129.1; 251/129.16; 335/277

[58] Field of Search ..... 123/90.11; 251/129.01, 251/129.02, 129.05, 129.09, 129.1, 129.15, 129.16; 335/257, 277

[56] References Cited

U.S. PATENT DOCUMENTS 4,515,343 5/1985 Pischinger et al. ..... 251/48
4,831,973 5/1989 Richeson, Jr. ..... 123/90.11
5,636,601 6/1997 Moriya et al. ..... 123/90.11
5,638,781 6/1997 Sturman ..... 123/90.12

FOREIGN PATENT DOCUMENTS 38 26 974 2/1990 Germany .
196 10 468 2/1997 Germany .

*Primary Examiner*—Weilun Lo
*Attorney, Agent, or Firm*—Venable; George H. Spencer; Catherine M. Vorrhees

[57] ABSTRACT

An electromagnetic actuator for actuating a gas-exchange valve in a reciprocating internal combustion engine, the electromagnetic actuator comprising: an armature which is operatively connected to the gas-exchange valve; two electromagnets, each having a pole face; two oppositely oriented restoring springs; wherein the armature is guided in a reciprocating manner counter to the force of the two oppositely oriented restoring springs between the pole faces of the two electromagnets whose current supply can be controlled by a control device, the two electromagnets being disposed in mutual spacing and acting as opening and closing devices; and at least one additional mass which is associated with the gas-exchange valve and can be guided so that it is movable relative thereto and in the same direction of the gas-exchange valve, the at least one additional mass entering into operative connection with the gas-exchange valve, in the final phase of the armature's motion in the direction of a respective one of the two electromagnets, via a coupler.

15 Claims, 3 Drawing Sheets

ELECTROMAGNETIC ACTUATOR WITH IMPACT DAMPING

BACKGROUND OF THE INVENTION

In electromagnetic actuators for actuating the gas-exchange valves of an internal combustion, there is a need to achieve high switching speeds and at the same time high switching forces. These actuators essentially comprise an armature, which is connected to a gas-exchange valve to be actuated and is guided to reciprocate counter to the force of two oppositely oriented restoring springs between the pole faces of two spaced-apart electromagnets. The electromagnets have a current supply which is controllable via a control device and act as opening and closing devices. For actuating the gas-exchange valve from one position, for instance the closing position, to the other, in this case the opening position, the holding current at the holding electromagnet is turned off. This causes the holding force of the magnet to drop below the spring force, and the armature begins to move, accelerated by the spring force. Once the armature has passed through its position of repose, the "flight" of the armature is braked by the spring force of the opposed restoring spring. In order now to intercept the armature in the opening position and hold it there, the corresponding magnet is supplied with current. In this interception process, the problem arises that the requisite induction of force by the magnet depends on numerous parameters. For instance, depending on the current engine load, the braking of the gas-exchange valve by gas forces, particular for the outlet valve, is highly variable. Moreover, the energy required for the interception is subject to influence by mass-production variations and from wear. Correspondingly, the "correct" energy supply for proper operation is quite important. If the energy supplied to the intercepting electromagnet is too high, then because of the overly high impact speed, severe wear occurs along with an unacceptable noise level. Under unfavorable circumstances, The armature can even bounce away again and thus put the valve out of operation for this stroke. If the energy supplied to the intercepting electromagnet is too low, then the armature is not intercepted, and the gas-exchange valve swings back again, so that at least in this cylinder cycle proper operation will not occur.

To overcome these problems, the attempt has already been made to reduce the impact speed of the armature by providing buffers comprising damping materials. However, problems of wear that could hardly be solved resulted.

The attempt was also made to solve the problem by providing air damping, as described in German Patent Disclosure DE-A 38 26 974. The disposition of an air damper presents engineering problems upon conversion to mass production. Particularly the construction of rectangular armature cross sections presents considerable problems in this respect. Moreover, energy losses that can longer be ignored result. In both known attempts to solve these problems, the disadvantage also exists that adaptation to changing operating parameters or wear factors is impossible.

SUMMARY OF THE INVENTION

The object of the invention is to create an electromagnetic actuator by which these disadvantages are maximally avoided.

According to the invention, this object is attained by an electromagnetic actuator for actuating a gas-exchange valve in a reciprocating internal combustion engine, having an armature which is operatively connected to the gas-exchange valve and is guided in reciprocating manner counter to the force of two oppositely oriented restoring springs between the pole faces of two electromagnets whose current supply can be controlled by a control device. The electromagnets are disposed in mutual spacing and act as opening and closing devices, and have at least one additional mass, which is associated with the gas-exchange valve and can be guided so that it is movable relative thereto and in the same direction, and which enters into operative connection with the gas-exchange valve, in the final phase of the armature's motion in the direction of the intercepting electromagnets, via a coupler. This has the advantage that because of the impact between the gas-exchange valve and the additional mass just before the armature strikes the pole face of the intercepting electromagnet, the speed of motion of the armature is reduced, in accordance with the size ratios between the additional mass on the one hand and the moving mass formed by the armature and the gas-exchange valve on the other. It is especially expedient in this respect if in a feature of the invention the additional mass is assigned a retaining spring, whose force action is oriented counter to the direction of motion of the additional mass in the final phase of the motion of the gas-exchange valve. By means of this retaining spring, the additional mass is always held in the outset position, so that the impact process described above is assured.

It is also expedient that one additional mass each is assigned to the gas-exchange valve for its closing position and its opening position, respectively. The additional mass must not be chosen as overly large, and it should not exceed the total moving mass formed by the armature and the gas-exchange valve. It is expedient if the size of an additional mass amounts to approximately one-fourth the total mass of the moving parts of the gas-exchange valve including the armature.

In an advantageous feature of the invention it is also provided that at least one of the electromagnets is assigned an additional magnet whose current supply is controllable, and that the additional mass forms an additional armature for the additional magnet. This arrangement has the advantage that upon impact of the coupler of the gas-exchange valve on the additional mass, the motion process of the total mass formed by the armature and gas-exchange valve is sharply decelerated, not only by the suddenly added mass of the additional armature, in accordance with the above-described principle of impetus preservation but also by the additional magnet force of the additional armature magnet and optionally by the force of a retaining spring, if present, with a low spring constant and/or fastening of the additional magnet by means of an elastic damping material. By means of a corresponding current supply to the additional magnet, variable forces can thus be established, so that by suitable control of the current supply to the additional magnet, varying operating parameters can be reacted to. It is expedient in this respect if an air gap is present between the pole face of the additional magnet and the additional armature when the additional armature is in contact therewith. An air gap of a maximum of 0.3 mm and preferably 0.1 mm and less is expedient in this respect. This makes it possible to reduce the vulnerability of the system with regard to tolerances. By way of example, this can be achieved by means of different lengths of the lugs of the magnet poles of the additional magnet.

In another expedient feature of the invention, it is also provided that an air gap is present between the armature and the pole face of the intercepting electromagnet, when the additional armature is resting on the pole face of the additional magnet. The size of this air gap forms the so-called delay spacing. The value of the delay spacing should amount at maximum to 1 mm. Values between 0.3 mm and 0.8 mm have been found to be favorable.

BRIEF DESCRIPTION OF THE DRAWINGS

Further advantageous features can be learned from the ensuing description and the schematic drawings of an exemplary embodiment where.

DESCRIPTION OF THE PREFERRED EMBODIMENT

Figure 1:
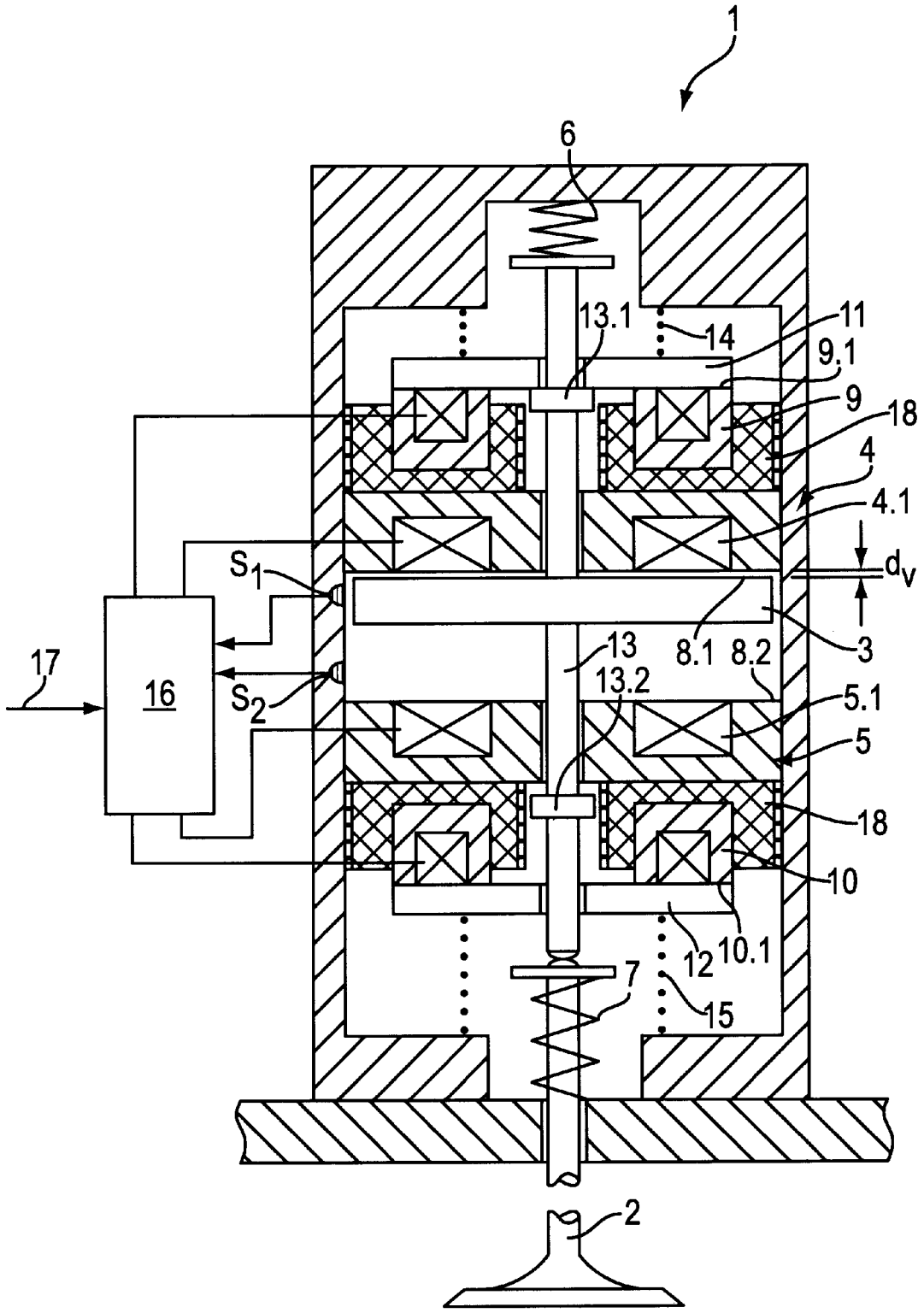
FIG. 1 is a view in cross-section of an electromagnetic actuator for actuating a gas-exchange valve.

The electromagnetic actuator 1 schematically shown in FIG. 1 has an armature 3, connected to a gas-exchange valve 2 (here represented only by its shaft), as well as a closing magnet 4 and an opening magnet 5 that are assigned to the armature 3. The armature 3 is held in a position of repose between the two magnets 4 and 5 via restoring springs 6 and 7, when the magnets are without electrical current; the spacing from the pole faces 8.1 and 8.2 at any time depends on the design of the springs 6 and 7. In the nearly completed closing position of the gas-exchange valve shown here, the armature 3 is located just before it reaches the pole face 8.1 of the magnet 4.

For actuating the gas-exchange valve 2, or in other words initiate the motion from the closed position to the opened position, the holding current at the closing magnet 4 is turned off. As a result, the holding force of the closing magnet 4 drops below the spring force of the restoring spring 6, and the armature 3 begins to move, accelerated by the spring force. Once the armature 3 has passed through its position of repose, the "flight" of the armature 3 is braked by the spring force of the restoring spring 7 assigned to the opening magnet 5. In order to intercept the armature now and shift it to the opening position and hold it there, the opener magnet 5 is subjected to electric current, causing the armature 3 then to contact the pole face 8.2 of the electromagnet 5. For closing the gas-exchange valve, the course of switching and motion then proceeds in the opposite direction.

The two electromagnets 4 and 5 are assigned additional magnets 9 and 10, which are likewise embodied as electromagnets and whose pole faces 9.1 and 10.1, respectively, face away from the pole faces 8.1 and 8.2 of the associated electromagnets 4 and 5. The additional magnets 9 and 10 are each assigned a respective additional mass 11 and 12 as an armature, and the respective armature is held in a relatively displaceable way relative to a guide rod 13 connected to the armature 3. The guide rod 13 is provided in each end region with a respective coupler 13.1 and 13.2, by which, in the final phase of the applicable motion of the armature 3 just before the armature strikes the pole face 8.1, the associated additional mass 11 or 12 is lifted away from the pole face 9.1 or 10.1 of the applicable additional magnet. Via a respective retaining spring 14 and 15, the corresponding additional masses 11 and 12 are pressed away from the pole face 9.1 and 10.1 of the respective additional magnet 9 and 10. The arrangement here is selected such that the additional masses 11 and 12 acting as armatures do not rest directly on the armature in the position of repose or holding position; instead, a small air gap remains between the additional masses and the associated pole faces.

In order to attenuate the introduction of force of the impact process into the engine or cylinder head structure upon impact of the coupler 13.1 or 13.2 on the additional mass 11 or 12, the additional magnets 9 and 10 are expediently connected to the other components of the actuator via an elastic damping material 18 connected between them.

The spacing of the coupler 13.1 and 13.2 from the armature 3 is dimensioned such that each of the coupler comes into operative connection with the associated additional masses whenever a slight air gap $d_v$, which amounts to a maximum of 1 mm, still remains between the armature 3 and the associated pole face of the electromagnet. The effect of this is that the respective additional mass, in the final phase of the motion of the armature 3 in the direction of the particular intercepting electromagnet, is lifted away.

The triggering of the current supply to electromagnets 4 and 5 is effected via a control device 16, which may be part of a central engine control unit, and to which the signals resulting from whatever operating mode is desired are supplied and by way of which the various specifications for actuating the electromagnets and the additional magnets are supplied, such as turn-on and turn-off times, current level, change in current, and the pulsing of the holding current.

Figure 2:
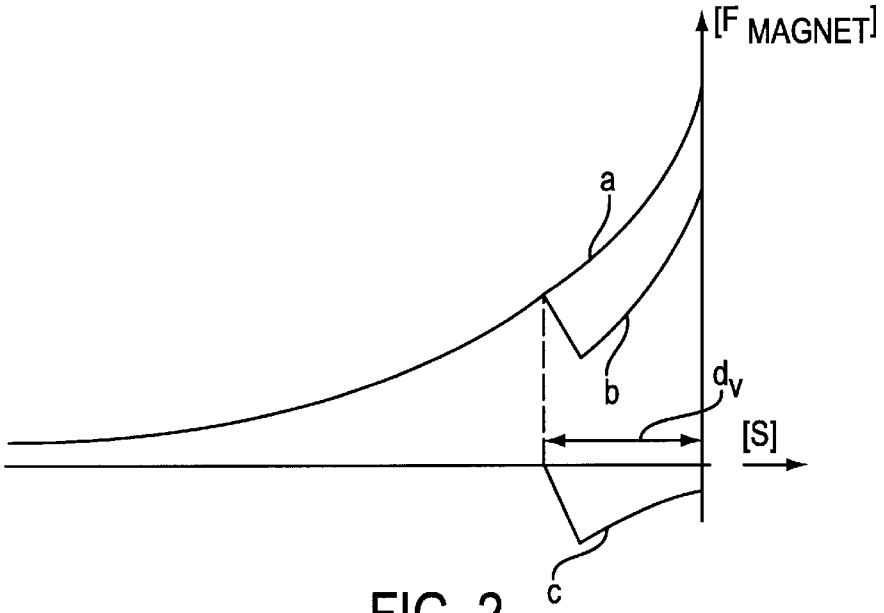
FIG. 2 illustrates the course of the magnet force over the armature travel.

In FIG. 2, curve a represents the course of the magnet force over the armature travel for an electromagnetic actuator without an additional mass.

If as described above in conjunction with FIG. 1 an additional mass embodied as an armature for an additional magnet is provided, and if the additional magnet is correspondingly supplied with current, then for instance upon a motion of the armature 3 toward the pole face 8.1 in the final phase of the motion, because of the specified delay gap $d_v$, first the coupler 13.1 strikes the additional mass 11, so that the additional magnet is first moved counter to the restoring force of the damping material 18, and the contrary force rises until the holding force of the additional magnet 9 is exceeded and the additional mass 11 is lifted away from the pole face 9.1. The tensile force of the additional magnet then decreases as the spacing increases. The additional forces are represented by the course of curve c, while the course of curve b represents the total resultant force.

Figure 3:
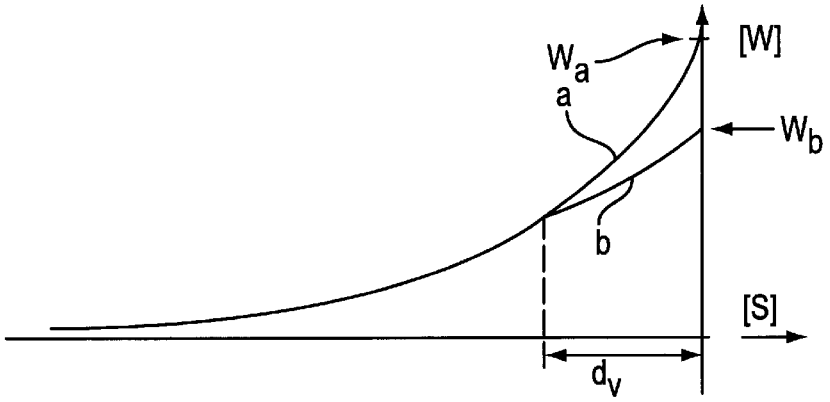
FIG. 3 illustrates the course of the energy introduced by the magnet as a function of the armature travel.

Corresponding to this, FIG. 3 shows the course of the energy, introduced by the electromagnet 4 in the described motion process, as a function of the armature travel. Here, curve a shows the work W=Fds, stored in the armature-spring system, for the case where there is no additional mass. Curve b shows the corresponding work W for the case where there is damping, in which case the spacing $d_v$ represents the size of the delay gap. If one assumes that curve course b represents the energy required by the system for precise compensation of losses from friction—the impact of the armature 3 on the pole face 8.1 or 8.2 at the lowest possible speed $v_b$—then the energy introduced in accordance with curve course a is overly high. The difference $W_a - W_b$ is then equivalent to the impact work achieved, $W = \frac{1}{2} m v_a^2$. In that case, $v_a$ is the impact speed of the armature 3 on the pole face 8.1 or 8.2, as can be seen from FIG. 4.

Figure 4:
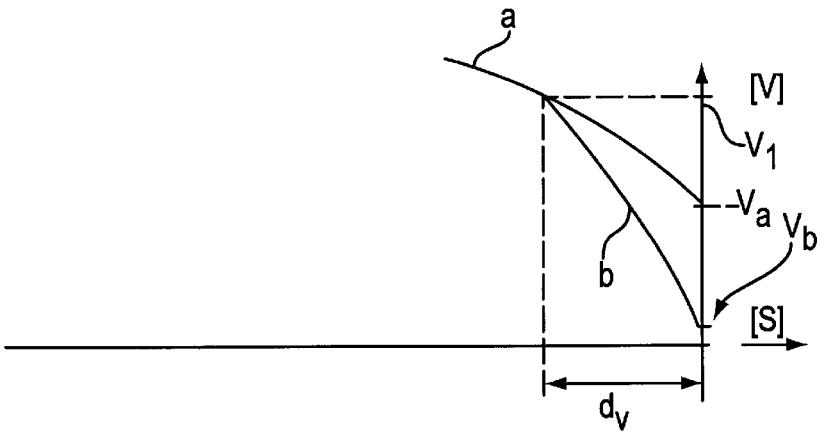
FIG. 4 illustrates the speed of motion of the armature system over the armature travel.

FIG. 4, corresponding to this, shows the motion speed of the armature system. Here, curve a represents the course of the speed without the presence of an additional mass, and curve b shows the course of the speed when there is an activated additional magnet. It can be seen that the impact speed or impact energy is markedly less, in a system with additional magnets and damping, than in the system without additional magnets.

For regulating the impact speed of the armature 3 on the respective pole face, various possible embodiments of the control strategy exist. In a first embodiment, it is possible with a measuring instrument to determine the motion speed to determine the motion speed of the armature 3 at at least one point along the travel course.

As shown in FIG. 1, this can be done for instance by means of two sensors S1 and S2, which are assigned to the armature 3 between the two pole faces 8.1 and 8.2 and by way of which, upon each armature motion between the two pole faces, the actual instant of the flight past the sensor can be detected twice in succession. The signals tripped by the sensors S1 and S2 are carried to the control device 16, in which in accordance with a predetermined control program, which via the external input means 17 can further be variable with regard to the predetermined set-point times, the actuators of the gas-exchange valves are triggered. The times for the turn-on and shutoff and the control of the current intensity of whichever is the intercepting magnet at the time is derived from the comparison of set-point and actual values, that is, the actual values detected by the sensors S1 and S2 compared with the set-point values each specified via the control device 16, and the electromagnets 4 and 5 are triggered accordingly. Via the sensors S1 and S2, not only can the actual flight times be detected, but also, by suitable recalculation, the actual flight speed and thus the expected impact speed can be ascertained.

If the ascertained speed value is too high, then the current through the additional magnet assigned to the respective intercepting magnet is increased accordingly. As a result, the energy required to move the additional mass away from the additional magnet is increased, and the armature 3 is braked correspondingly more strongly, so that the impact speed is reduced accordingly. If the speed is below a predetermined set-point speed, then the current for the additional magnet is reduced accordingly. The closed control loop described should suitably be designed as a PID controller (for proportional-integral-differential controller) with a nonlinear characteristic curve. By proceeding in this way it is possible also to react to variations in the armature speed in the particular cycle. This is particularly desirable for actuators for actuating gas outlet valves, because there, cyclical fluctuations in the combustion produce correspondingly variable speed courses of the armature-valve system, since the gas forces that act on the gas outlet valve change.

As a provision for compensating for production tolerances or wear phenomena, conversely, it suffices to evaluate information from the proceeding cycle at the time. Thus it is then also possible to detect the impact speed of the armature 3 at the associated pole face 8.1 or 8.2 directly. This variable can then be used as the basis for setting the current supply to the additional magnets for the next cycle.

Another possibility is, instead of the above-described ascertainment of the impact speed of the armature, to detect the release of the additional mass from the additional magnet. This utilizes the effect that because of the sudden release of the armature from the additional magnet, a voltage is induced in the coil of the additional magnet, whose magnitude depends on the speed of the additional mass as it moves away. The level of this voltage can be used as an excellent standard for the speed of the armature-valve system.

Figure 5:
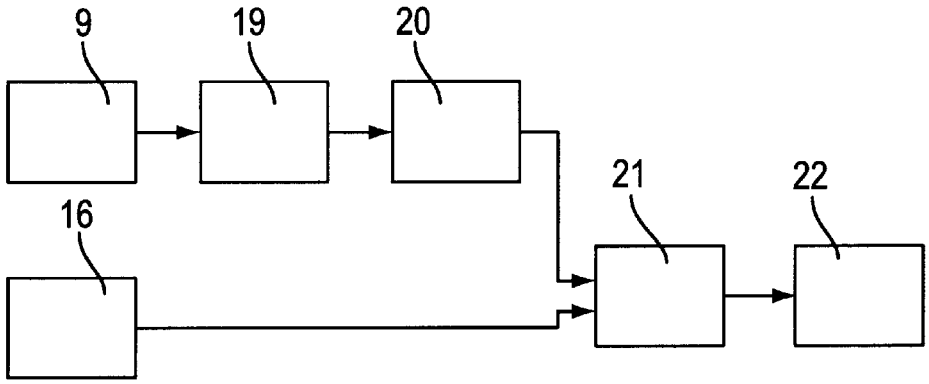
FIG. 5 shows a circuit arrangement for regulating the impact speed of the armature by detecting the separation of the additional armature.

FIG. 5 shows a corresponding device for performing that method. At the coil, for instance of the additional magnet 9, the first derivation of the voltage of the additional magnet is formed by means of a differentiating member 19. In a peak value detector 20, the maximum valve of the voltage change is ascertained, and with the aid of a comparator 21, it is compared with a reference value that by way of example is stored in memory in the control device 16 or a separate engine control unit. An excessively high voltage causes an increased set-point specification of the current through the additional magnet for the next cycle. The set-point specification is retained for the next cycle in a sample and hold circuit 22. An excessively low voltage, corresponding to an excessively low speed, causes a decrease in the set-point specification for the next cycle.

However, an overly low speed may under some circumstances mean that the armature 3 will no longer reach its pole face 8.1 or 8.2. In that case, precautions must be taken. For instance, the usual switchover to holding current at the intercepting magnet, which for energy reasons normally takes place after the conclusion of the interception phase, may be prevented. In that case, the armature would be held in a position corresponding to the delay spacing dv between the pole face 8.1 or 8.2 of the intercepting electromagnet and the armature, depending on the dimensioning of the entire system. Moreover, the intercepting current can be increased further, so that the armature will still be pulled into its correct position nevertheless. This can be further reinforced by turning off the current through the additional magnet. These last precautions are especially appropriate for the closing magnet 4, since an incomplete closure of the gas-exchange valve can lead to fatal malfunctions. If for any reason it should not be possible for the armature 3 to be attracted into the final position against the pole face 8.1 or 8.2, then the compression would have to be suppressed for that cycle, specifically by turn off the fuel injection and/or ignition. On the other hand, if a certain quantity of fuel has already been introduced, then a modified triggering of the remaining gas-exchange valves may also be appropriate. For instance, an actuation of the outlet valves may be suppressed so that no uncombusted mixture will reach the gas outlet duct.

As a decision criterion for the noncontact of the armature with its pole face, a contact detector, either of the armature 3 itself or of the additional mass, may furthermore be used. During a correct function, the contact of the armature 3 with respective pole face 8.1 and 8.2 and a noncontact of the additional mass with the corresponding pole face of the additional magnet must be detected.

The embodiment shown in FIG. 1 for an electromagnetic actuator may be utilized as an active system as well during operation of a reciprocating internal combustion engine. Electromagnetic actuators for gas-exchange valves in reciprocating internal combustion engines are entirely variable in terms of their actuation, so that depending on the specifications of the control device, virtually arbitrary tunings of the opening and closing times to one another are possible. In reciprocating engines in which the fuel is injected into the gas inlet duct, modes of operation with so-called duct shutoff are also provided in the control program. This means that depending on the load specification, individual cylinders are deactivated, on the one hand by turning off fuel injection for a predeterminable number of work cycles and not opening the gas inlet valve. However, since small quantities of fuel can collect in the gas inlet duct from the preceding cycles, when that inlet duct is opened again an incorrect fuel metering in the cylinders that resume operation would be the result. If with the gas inlet duct basically out of action, the additional magnet of the gas inlet valve that is kept closed is supplied with current while the armature contacts it, then the gas inlet valve opens by a standard that is specified by the delay spacing of the main armature from the pole face of the holding magnet, so that the fuel collecting at the gas inlet valve can enter the cylinder. It may be expedient for the holding current of the associated holding electromagnet to be reduced or briefly turned off at the same time. The supply of current to the holding electromagnet must be guided such that the armature will not drop all the way but rather be held in an equilibrium position precisely at the delay spacing. Once this microscopic stroke, which is used merely to blow out any accumulations of fuel upstream of the valve, is ended, the additional magnet is deprived of current again, and the valve is kept in the closing position.

The arrangement of the additional magnets described in conjunction with FIG. 1 can perform still another task. Because of various factors, especially the phenomenon of so-called sticking of an armature on a holding magnet, it can happen that upon a shutoff of the holding current, the armature will separate from the pole face of the holding magnet with a time lag. These time lags must therefore be taken into account in determining the shutoff time, in order to bring about an accurately timed onset of motion of the armature and thus accurate times for opening or closing of the gas-exchange valve. The influence of the "sticking" can now be counteracted by providing that the existing additional magnet, which at the termination of armature motion acts as a damping or braking magnet, is used as an accelerating magnet at the onset of armature motion, given a suitable current supply. To initiate the process of expulsion of the armature from the holding electromagnet, the holding current through the electromagnet is turned off, and depending on the dimensioning either just beforehand, just after, or at the same time the additional magnet is supplied with current or acted upon by an increased current. As a result, in addition to the action of the restoring spring, an additional force is brought to bear on the gas-exchange valve and accelerates the process of separation of the armature from the holding magnet. As a result, the time of the onset of motion can be set more precisely.

In principle, for the sake of a rapid buildup and reduction of the magnetic field in the coil of the additional magnet, the magnet should be laminated. However, if this kind of rapid buildup and reduction of fields is not desired, such as in closed-loop control of the armature speed that merely causes a change in current level from one cycle to another, it is appropriate instead to make the additional magnets solid. This causes eddy current losses, which are greater the higher the armature speed. Thus with high separation speeds of the additional armature and thus high approach speeds of the armature 3, greater losses occur, which brings about a partial compensation for the overly rapid motion caused by the eddy current losses.

It is also possible for the losses and thus the additional damping effect to be controlled in a targeted way. To this end, an adaptation of a load resistor to the additional magnet, or a variable shutoff voltage, can be achieved. This principle is explained in further detail in FIGS. 6 and 7 in terms of exemplary circuits. In each case, the wiring of only one additional magnet is shown.

Figure 6:
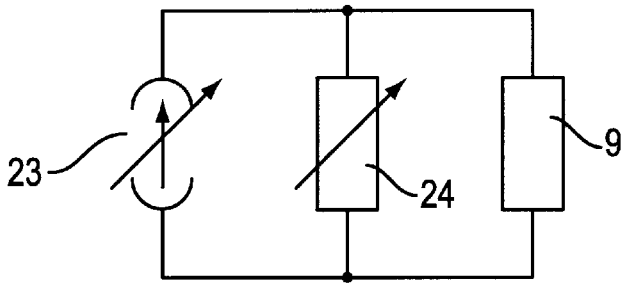
FIG. 6 shows a circuit arrangement for varying the current losses at the additional magnet.

In the circuit shown in FIG. 6, the additional magnet 9, represented here by its inductance, is supplied by a current source 23 of variable current level. A variable resistor 24 can be used to achieve the effect described above as an eddy current. When set to a very high resistance (toward the infinite), practically no "teddy current" flows. The field of the additional magnet 9 can vary correspondingly quickly, and the energy drawn from the kinetic energy of the armature is slight. If the resistance is reduced, for example to a value at which power adaptation is just present, then the energy loss is maximal.

Figure 7:
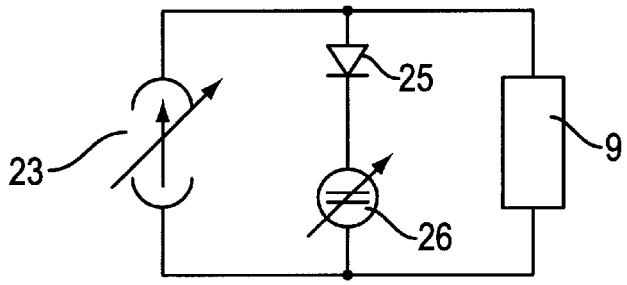
FIG. 7 illustrates a modification of the circuit of FIG. 6.

FIG. 7 shows a circuit that functions similarly. Once again, the electromagnet 9, represented by its inductance, is supplied from a current source 23. Via a diode 25, a variable voltage source 26 is connected; when adjusted to a very high voltage, it merely causes a slight "eddy current" and thus only a slight energy withdrawal, while at a low voltage it brings about a correspondingly major energy withdrawal. These circuits are merely intended to illustrate the principle. Many variant circuits can intrinsically be derived from them. For instance, a voltage limiting circuit that is adjustable via transistors can be used instead of the diode and the variable voltage source.

In order now, in the current supply to the respective additional magnet, to enable a rapid rising current without additional expenditure of energy, the additional magnet is expediently connected to the electromagnet that is turned off. The voltage that builds up at the coil of the electromagnet that turning off then causes a flow of current in the coil of the applicable additional magnet that is to be turned on. Since the coil of the additional magnet resists this flow of current because of its inductive behavior, the voltage furnished by the coil that is turning off rises to a very high value, in order to force the current flow through the coil that is to be turned on, by means of a steep current rise. Because of the energy losses and the decreasingly strong current rise, the voltage of the coil drops through the electromagnet that in the mean time has been turned on via the current supply, until the current supply voltage that is available via the current supply is greater and the current flow achieved can be maintained. In this way, it is possible to meet the demand for high switching speeds.

What is claimed is:

1. An-electromagnetic actuator for actuating a gas-exchange valve in a reciprocating internal combustion engine, said electromagnetic actuator comprising:

an armature which is operatively connected to the gas-exchange valve;

two electromagnets, each having a pole face;

two oppositely oriented restoring springs; wherein said armature is guided in a reciprocating manner counter to the force of the two oppositely oriented restoring springs between the pole faces of the two electromagnets whose current supply can be controlled by a control device, said two electromagnets being disposed in mutual spacing and act as opening and closing electromagnets; and at least one additional mass, which is associated with the gas-exchange valve and can be guided so that it is movable relative thereto and in the same direction of the gas-exchange valve, said at least one additional mass entering into operative connection with the gas-exchange valve, in the final phase of the armature's motion in the direction of a respective one of the two electromagnets, via a coupler.

2. The actuator of claim 1, further comprising a retaining spring, the additional mass being provided with the retaining spring, the force action of the retaining spring being oriented counter to the direction of motion of the additional mass in the final phase of the motion of the gas-exchange valve.

3. The actuator of claim 1, wherein said at least one additional mass is assigned to the gas-exchange valve for its closing position and its opening position, respectively.

4. The actuator of claim 1, wherein the size of an additional mass amounts to approximately one-fourth the total mass of the moving parts of the gas-exchange valve including the armature.

5. The actuator of claim 1, wherein at least one of the two electromagnets is assigned an additional magnet having a pole face and whose current supply is controllable, and that the at least one additional mass forms an additional armature for the additional magnet.

6. The actuator of claim 5, wherein an air gap of a maximum of 0.3 mm is present between the pole face of the additional magnet and the additional armature, when the additional armature is in contact therewith.

7. The actuator of claim 5, wherein an air gap which forms a delay spacing and amounts to a maximum of 1 mm is present between the armature and the pole face of the respective electromagnet at the moment the coupler engages the additional armature.

8. The actuator of claim 5, wherein the additional magnet is secured to the actuator via an elastic damping material.

9. The actuator of claim 5, further comprising at least one sensor for detecting the speed of motion of an armature to which the sensor is assigned, said at least one sensor being connected to the control device for controlling the current supply to the electromagnets and additional magnets.

10. The actuator of claim 5, wherein the control device for controlling the current supply to the electromagnets and the additional magnets has a circuit arrangement by which the current supply to the additional magnets is controlled as a function of the speed of motion of the armature.

11. The actuator of claim 5, wherein the control device for controlling the current supply to the electromagnets and the additional magnets has a circuit arrangement for detecting the impact of the armature on a pole face of the respective electromagnet, and/or for detecting the release of the additional armature from the pole face of the additional magnet, which circuit arrangement is connected to a circuit for controlling fuel injection and/or a ignition system.

12. The actuator of claim 7, wherein the additional magnet is assigned to the closing electromagnet and is connected to the control device for the current supply in such a way that when a holding current is turned on at the closing electromagnet, the additional magnet is supplied with such a strong current counter to the force of the closing electromagnet that the gas-exchange valve is opened by a stroke of the additional armature equal to the delay spacing.

13. The actuator of claim 12, wherein the control device for controlling the current supply is embodied such that a current is supplied to the additional magnet upon shutoff of the holding current to the electromagnets.

14. The actuator of claim 5, wherein the control device for controlling the current supply has a circuit arrangement, which via a variation of the turn-on voltage and/or the shutoff voltage at whichever additional magnet is operative at the time effects a change in the damping exerted by the additional magnet, with its additional armature, on the gas-exchange valve.

15. The actuator of claim 6, wherein the air gap is 0.1 mm and less.

* * * * *